United States Patent [19]

Machonkin et al.

[11] Patent Number: 5,041,355

[45] Date of Patent: Aug. 20, 1991

[54] HIGH CONTRAST PHOTOGRAPHIC ELEMENT INCLUDING AN ARYL SULFONAMIDOPHENYL HYDRAZIDE CONTAINING ETHYLENEOXY GROUPS

[75] Inventors: Harold I. Machonkin, Webster; Kerr: Donald L., Rochester, both of N.Y.

[73] Assignee: Eastman Kodak Company, Rochester, N.Y.

[21] Appl. No.: 528,651

[22] Filed: May 24, 1990

[51] Int. Cl.[5] ..... G03C 1/06

[52] U.S. Cl. ..... 430/264; 430/410; 430/598

[58] Field of Search ..... 430/264, 410, 598

[56] References Cited

U.S. PATENT DOCUMENTS

| | | | |
|---|---|---|---|
| 4,681,836 | 7/1987 | Inoue et al. | 430/434 |
| 4,824,774 | 4/1989 | Inoue et al. | 430/566 |
| 4,912,016 | 3/1990 | Machonkin et al. | 430/264 |
| 4,933,273 | 6/1990 | Gilman, Jr. et al. | 430/597 |
| 4,971,890 | 11/1990 | Okada et al. | 430/264 |

FOREIGN PATENT DOCUMENTS 0286840 10/1988 European Pat. Off. .

*Primary Examiner*—Charles L. Bowers, Jr.
*Assistant Examiner*—Janis L. Dote
*Attorney, Agent, or Firm*—Alfred P. Lorenzo

[57] ABSTRACT

Silver halide photographic elements which are capable of high contrast development having incorporated therein, as a nucleating agent, an aryl sulfonamidophenyl hydrazide of the formula:

where each R is a monovalent group comprised of at least three repeating ethyleneoxy units, n is 1 to 3, and $R^1$ is hydrogen or a blocking group.

6 Claims, No Drawings

HIGH CONTRAST PHOTOGRAPHIC ELEMENT INCLUDING AN ARYL SULFONAMIDOPHENYL HYDRAZIDE CONTAINING ETHYLENEOXY GROUPS

FIELD OF THE INVENTION

This invention relates in general to photography and in particular to novel black-and-white photographic elements. More specifically, this invention relates to novel silver halide photographic elements, such as lithographic films used in the field of graphic arts, which are capable of high contrast development.

BACKGROUND OF THE INVENTION

High contrast development of lithographic films has been carried out for many years using special developers which are known in the art as "lith" developers. In conventional "lith" developers, high contrast is achieved using the "lith effect" (also referred to as infectious development) as described by J. A. C. Yule in the Journal of the Franklin Institute, Vol. 239, 221–230, (1945). This type of development is believed to proceed autocatalytically. To achieve "lith effect" development, a low, but critical, concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Conventional "lith" developers suffer from serious deficiencies which restrict their usefulness. For example, the developer exhibits low capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to the air.

An alternative to the use of conventional "lith" developers is disclosed in Nothnagle, U.S. Pat. No. 4,269,929, "High Contrast Development Of Photographic Elements", issued May 26, 1981, the disclosure of which is incorporated herein by reference. As described in this patent, high contrast development of photographic elements is carried out in the presence of a hydrazine compound with an aqueous alkaline developing solution which has a pH of above 10 and below 12 and contains a dihydroxybenzene developing agent, a 3-pyrazolidone developing agent, a sulfite preservative, and a contrast-promoting amount of an amino compound. The developing solution combines the advantages of high capacity, a high degree of stability, and a long effective life, while providing excellent contrast and speed characteristics.

In this art, the hydrazine compounds are typically referred to as "nucleators" or "nucleating agents" and the amino compounds which function to enhance contrast are referred to as "boosters".

U.S. Pat. No. 4,269,929 describes the use of a very wide variety of amino compounds as contrast-promoting agents. In particular, it discloses the use of both inorganic amines, such as the hydroxylamines, and organic amines, including aliphatic amines, aromatic amines, cyclic amines, mixed aliphatic-aromatic amines, and heterocyclic amines. Primary, secondary and tertiary amines, as well as quaternary ammonium compounds, are included within the broad scope of the disclosure.

While the invention of U.S. Pat. No. 4,269,929 represents a very important advance in the art, its commercial utilization has been hindered by the disadvantageous characteristics exhibited by many amino compounds. Thus, for example, some amines suffer from the problem of toxicity, some from the problem of excessive volatility, some are characterized by highly unpleasant odors, some tend to form azeotropes with water, some exhibit an inadequate degree of solubility in an aqueous alkaline photographic developing solution, and some are costly yet must be used at a relatively high concentration such that they constitute a substantial portion of the total cost of the developing solution. Moreover, many amines exhibit a degree of activity as contrast-promoters in the method and composition of U.S. Pat. No. 4,269,929 that is less than is desired for commercial operation.

High contrast developing compositions which contain amino compounds as "boosters" and are intended for carrying out development in the presence of a hydrazine compound are also disclosed in U.S. Pat. Nos. 4,668,605 issued May 26, 1987 and 4,740,452 issued Apr. 26, 1988 and in Japanese Patent Publication No. 211647/87 published Sept. 17, 1987. U.S. Pat. No. 4,668,605 describes developing compositions containing a dihydroxybenzene, a p-aminophenol, a sulfite, a contrast-promoting amount of an alkanolamine comprising an hydroxyalkyl group of 2 to 10 carbon atoms, and a mercapto compound. The developing compositions of U.S. Pat. No. 4,740,452 contain a contrast-promoting amount of certain trialkyl amines, monoalkyl-dialkanolamines or dialkylmonoalkanol amines. The developing compositions of Japanese Patent Publication No. 211647/87 contain a dihydroxybenzene developing agent, a sulfite and certain amino compounds characterized by reference to their partition coefficient values. However, the developing compositions of U.S. Pat. Nos. 4,668,605 and 4,740,452 and Japanese Patent Publication No. 211647/87 do not fully meet the needs of this art, as they exhibit many disadvantageous characteristics. These include the need to use the contrast-promoting agent in such large amounts as to add greatly to the cost of the process and the many difficult problems that stem from the volatility and odor-generating characteristics of amino compounds that are effective to enhance contrast.

The inherent disadvantages of incorporating amino compounds as "boosters" in developing compositions have been recognized in the prior art, and proposals have been made heretofore to overcome the problems by incorporating the amino compound in the photographic element. In particular, the use of amino compounds as "incorporated boosters" has been proposed in Japanese Patent Publication No. 140340/85 published July 25, 1985 and in Japanese Patent Publication No. 222241/87 published Sept. 30, 1987 and corresponding U.S. Pat. No. 4,914,003 issued Apr. 3, 1990. In Publication No. 140340/85, it is alleged that any amino compound can be utilized as an "incorporated booster", while Publication No. 222241/87 is directed to use as "incorporated boosters" of amino compounds defined by a specific structural formula. Publication No. 222241/87 points to some of the problems involved in following the teachings of Publication No. 140340/85 including problems relating to leaching of the amino compounds from the element during development and the generation of "pepper fog".

A photographic system depending on the conjoint action of hydrazine compounds which function as "nucleators" and amino compounds which function as "boosters" is an exceedingly complex system. It is influenced by both the composition and concentration of the "nucleator" and the "booster" and by many other factors including the pH and composition of the developer and the time and temperature of development. The goals of such a system include the provision of enhanced speed and contrast, together with excellent dot quality and low pepper fog. It is also desired that the amino compounds utilized be easy to synthesize, low in cost, and effective at very low concentrations. The prior art proposals for the use of amino compounds as "boosters" have failed to meet many of these objectives, and this has seriously hindered the commercial utilization of the system.

Copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 1988, describes the use as "nucleators" of aryl sulfonamidophenyl hydrazides which have one of the following structural formulae:

I

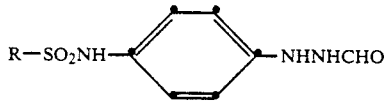

II

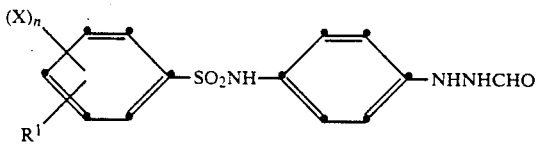

wherein;

R is alkyl having from 6 to 18 carbon atoms or a heterocyclic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2R^2R^3$ where $R^2$ and $R^3$, which can be the same or different, are hydrogen or alkyl having from 1 to about 4 carbon atoms; and n is 0, 1 or 2.

Commonly assigned U.S. patent application Ser. No. 200,273, "High Contrast Photographic Recording Material And Emulsion And Process For Their Development", by H. I. Machonkin, L. J. Fleckenstein and D. L. Kerr, filed May 31, 1988 and issued Mar. 27, 1990 as U.S. Pat. No. 4,912,016 describes the use as "nucleators" of aryl hydrazides of the formula:

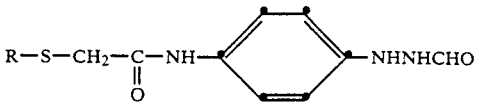

where R is an alkyl or cycloalkyl group.

Copending commonly assigned U.S. patent application Ser. No. 359,009, "Photographic Element And Process Adapted To Provide High Contrast Development", by H. I. Machonkin and D. L. Kerr, filed May 30, 1989 as a continuation-in-part of application Ser. No. 255,881 filed Oct. 11, 1988, and issued Dec. 4, 1990 as U.S. Pat. No. 4,975,354 describes the use of certain secondary or tertiary amino compounds which function as "incorporated boosters". These compounds contain within their structure a group comprised of at least three repeating ethyleneoxy units.

Copending commonly assigned U.S. patent application Ser. No. 528,650, "High Contrast Photographic Element Including An Aryl Sulfonamidophenyl Hydrazide Containing Both Thio And Ethyleneoxy Groups", by H. I. Machonkin and D. L. Kerr, filed May 24, 1990 and issued Jan. 29, 1991 as U.S. Pat. No. 4,988,604 describes the use as nucleating agents of hydrazides of the formula:

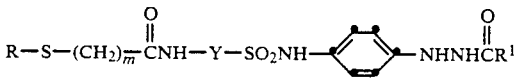

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

It is toward the objective of providing improved "nucleators" which exhibit advantages over those of the aforesaid references and which are especially useful in combination with "incorporated boosters" that the present invention is directed.

SUMMARY OF THE INVENTION

The present invention provides novel silver halide photographic elements which contain, in at least one layer of the element, certain aryl sulfonamidophenyl hydrazides which are highly advantageous as "nucleators". The aryl sulfonamidophenyl hydrazides which are employed in this invention can be represented by the formula:

I

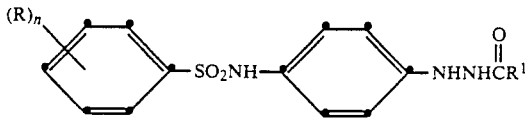

where each R is a monovalent group comprised of at least three repeating ethyleneoxy units, n is 1 to 3, and $R^1$ is hydrogen or a blocking group.

The blocking group represented by $R^1$ can be, for example:

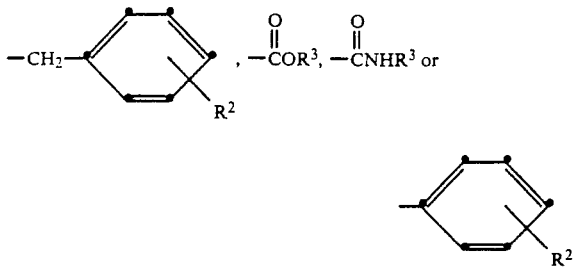

where $R^2$ is hydroxy or a hydroxy-substituted alkyl group having from 1 to 4 carbon atoms and $R^3$ is an alkyl group having from 1 to 4 carbon atoms.

Use of one or more groups comprised of at least three repeating ethyleneoxy units in the "ballast" of sulfonamidophenyl hydrazide "nucleators" has been unexpectedly found to increase their intrinsic activity and thereby lower the molar concentration which needs to be incorporated in the photographic element for effective nucleation.

DESCRIPTION OF THE PREFERRED EMBODIMENTS

In the practice of this invention, the hydrazide is incorporated in the photographic element. For example, it can be incorporated in a silver halide emulsion used in forming the photographic element. Alternatively, the hydrazide can be present in a hydrophilic colloid layer of the photographic element other than an emulsion layer, preferably a hydrophilic colloid layer which is coated to be contiguously adjacent to the emulsion layer in which the effects of the hydrazide are desired. It can, of course, be present in the photographic element distributed between or among emulsion and hydrophilic colloid layers, such as undercoating layers, interlayers and overcoating layers.

The hydrazide is typically employed at a concentration of from about $10^{-4}$ to about $10^{-1}$ moles per mole of silver, more preferably in an amount of from about $5\times10^{-4}$ to about $5\times10^{-2}$ moles per mole of silver, and most preferably in an amount of from about $8\times10^{-4}$ to about $5\times10^{-3}$ moles per mole of silver.

The hydrazides are employed in this invention in combination with negative-working photographic emulsions comprised of radiation-sensitive silver halide grains capable of forming a surface latent image and a binder. The silver halide emulsions include high chloride emulsions conventionally employed in forming lithographic photographic elements, as well as silver bromide and silver bromoiodide emulsions which are recognized in the art as being capable of attaining higher photographic speeds. Generally, the iodide content of the silver halide emulsions is less than about 10 mole percent silver iodide, based on total silver halide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process*, 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Research Disclosure, Item 308119, Vol. 308, December 1989.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

By suitable choice of substituent groups the dyes can be cationic, anionic or nonionic. Preferred dyes are cationic cyanine and merocyanine dyes. Emulsions containing cyanine and merocyanine dyes have been observed to exhibit relatively high contrasts. Spectral sensitizing dyes specifically preferred for use in the practice of this invention are as follows:

SS-1: Anhydro-5,5'-dichloro-9-ethyl-3,3'-bis(3-sulfopropyl)oxacarbocyanine hydroxide, sodium salt SS-2: 5,5',6,6'-Tetrachloro-1,1',3,3'-tetraethylbenzimidazolocarbocyanine iodide SS-3: 3,3'-Diethyl-9-methylthiacarbocyanine bromide SS-4: 3,3'-Diethyloxacarbocyanine iodide SS-5: 5,5'-Dichloro-3,3',9-triethylthiacarbocyanine bromide SS-6: 3,3'-Diethylthiocarbocyanine iodide SS-7: 5,5'-Dichloro-2,2'-diethylthiocarbocyanine, p-toluene sulfonate salt SS-8: 3-Carboxymethyl-5-[(3-methyl-2-thiazolidinylidene)-1-methylethylidene]rhodanine SS-9: 3-Ethyl-3-[3-ethyl-2-thiazolidinylidene)-1-methylethylidene]rhodanine SS-10: 5-[(3-(2-Carboxyethyl)-2-thiazolidinylidene)ethylidene]-3-ethylrhodanine SS-11: 1-Carboxymethyl-5-[(3-ethyl-2-benzothiazolinylidene)ethylidene]-3-phenyl-2-thiohydantoin SS-12: 1-Carboxymethyl-5-[(1-ethyl-2(H)-naphtho-[1,2-d]thiazolin-2-ylidene)ethylidene]-3-phenyl-2-thiohydantoin SS-13: 3-Carboxymethyl-5-[(3-ethyl-2-benzothiazolinylidene)ethylidene]rhodanine SS-14: 5-[3-Ethyl-2-benzoxazolinylidene)ethylidene]-3-heptyl-2-thio-2,4-oxazolidinedione SS-15: 3-Carboxymethyl-5-(3-ethyl-2-benzothiazolinylidene)rhodanine SS-16: 3-Carboxymethyl-5-(3-methyl-2-benzoxazolinylidene)rhodanine SS-17: 3-Ethyl-5-[3-ethyl-2-benzoxazolinylidene)ethylidene]rhodanine.

The photographic elements can be protected against fog by incorporation of antifoggants and stabilizers in the element itself or in the developer in which the element is to be processed. Illustrative of conventional antifoggants and stabilizers useful for this purpose are those disclosed in Research Disclosure, Vol. 308, December 1989, Item 308119.

It has been observed that both fog reduction and an increase in contrast can be obtained by employing benzotriazole antifoggants either in the photographic element or the developer in which the element is processed. The benzotriazole can be located in the emulsion layer or in any other hydrophilic colloid layer of the photographic element in a concentration in the range of from about $10^{-4}$ to $10^{-1}$, preferably $10^{-3}$ to $3\times10^{-2}$, mol per mol of silver. When the benzotriazole antifoggant is added to the developer, it is employed in a concentration of from $10^{-6}$ to about $10^{-1}$, preferably $3\times10^{-5}$ to $3\times10^{-2}$, mol per liter of developer.

Useful benzotriazoles can be chosen from among conventional benzotriazole antifoggants. These include benzotriazole (that is, the unsubstituted benzotriazole compound), halo-substituted benzotriazoles (e.g., 5-chlorobenzotriazole, 4-bromobenzotriazole and 4-chlorobenzotriazole) and alkyl-substituted benzotriazoles wherein the alkyl moiety contains from 1 to about 12 carbon atoms (e.g., 5-methylbenzotriazole).

In addition to the components of the photographic emulsions and other hydrophilic colloid layers described above it is appreciated that other conventional element addenda compatible with obtaining relatively high contrast images can be present. For example, addenda can be present in the described photographic elements and emulsions in order to stabilize sensitivity. Preferred addenda of this type include carboxyalkyl substituted 3H-thiazoline-2-thione compounds of the type described in U.S. Pat. No. 4,634,661. Also, the photographic elements can contain developing agents (described below in connection with the processing steps), development modifiers, plasticizers and lubricants, coating aids, antistatic materials, matting agents, brighteners and color materials.

The hydrazide compounds, sensitizing dyes and other addenda incorporated into layers of the photographic elements can be dissolved and added prior to coating either from water or organic solvent solutions, depending upon the solubility of the addenda. Ultrasound can be employed to dissolve addenda. Semipermeable and ion exchange membranes can be used to introduce addenda, such as water soluble ions (e.g. chemical sensitizers). Hydrophobic addenda, particularly those which need not be adsorbed to the silver halide grain surfaces to be effective, such as couplers, redox dye-releasers and the like, can be mechanically dispersed directly or in high boiling (coupler) solvents, as illustrated in U.S. Pat. Nos. 2,322,027 and 2,801,171, or the hydrophobic addenda can be loaded into latices and dispersed.

In forming photographic elements the layers can be coated on photographic supports by various procedures, including immersion or dip coating, roller coating, reverse roll coating, doctor blade coating, gravure coating, spray coating, extrusion coating, bead coating, stretch-flow coating and curtain coating. High speed coating using a pressure differential is illustrated by U.S. Pat. No. 2,681,294.

The layers of the photographic elements can be coated on a variety of supports. Typical photographic supports include polymeric film, wood fiber, e.g., paper, metallic sheet or foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamines, homo- and co-polymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like.

Polyolefins, such as polyethylene, polypropylene and polyallomers, e.g., copolymers of ethylene with propylene, as illustrated by U.S. Pat. No. 4,478,128, are preferably employed as resin coatings over paper, as illustrated by U.S. Pat. Nos. 3,411,908 and 3,630,740, over polystyrene and polyester film supports, as illustrated by U.S. Pat. Nos. 3,630,742, or can be employed as unitary flexible reflection supports, as illustrated by U.S. Pat. No. 3,973,963.

Preferred cellulose ester supports are cellulose triacetate supports, as illustrated by U.S. Pat. Nos. 2,492,977; 2,492,978 and 2,739,069, as well as mixed cellulose ester supports, such as cellulose acetate propionate and cellulose acetate butyrate, as illustrated by U.S. Pat. No. 2,739,070.

Preferred polyester film supports are comprised of linear polyester, such as illustrated by U.S. Pat. Nos. 2,627,088; 2,720,503; 2,779,684 and 2,901,466.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., MacMillan, 1977, Chapters 4, 6, 17 18 and 23.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent. Very high contrast images can be obtained at pH values in the range of from 11 to 12.3, but preferably lower pH values, for example below 11 and most preferably in the range of about 9 to about 10.8 are preferably employed with the photographic recording materials as described herein.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963), the disclosures of which are here incorporated by reference. The photographic elements can, of course, be processed with conventional developers for lithographic photographic elements, as illustrated by U.S. Pat. No. 3,573,914 and U.K. Patent No. 376,600.

It is preferred that the novel photographic elements of this invention are processed in developing compositions containing a dihydroxybenzene developing agent. It is more preferred that they are processed in a developing composition containing an auxiliary super-additive developing agent in addition to the dihydroxybenzene which functions as the primary developing agent. It is especially preferred that the auxiliary super-additive developing agent be a 3-pyrazolidone.

As previously described herein, a hydrazide of formula I is incorporated in the photographic element in accordance with this invention as a "nucleator". The hydrazide contains within its structure a group comprised of at least three repeating ethyleneoxy units, and more preferably comprised of at least six and up to fifty repeating ethyleneoxy units. One or more of such groups can be included in the "ballast". Preferably the hydrazide has a "partition coefficient", as hereinafter defined, of at least three. Preferably, the photographic element also includes an "incorporated booster" of the structure described in U.S. patent application Ser. No. 359,009 filed May 30, 1989, to which reference has been made hereinbefore.

Examples of hydrazides of formula I which are particularly effective for the purposes of this invention include:

I-1
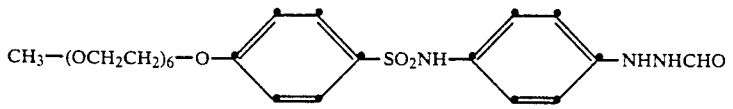
I-2
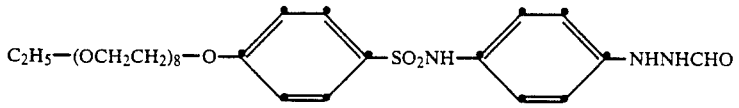
I-3
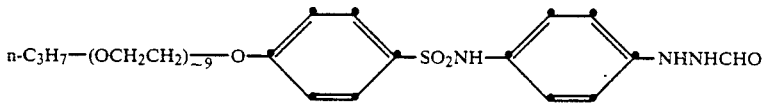
I-4
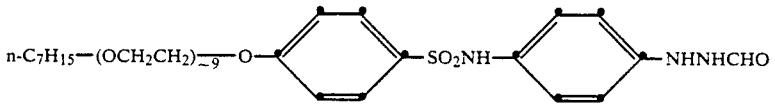
I-5
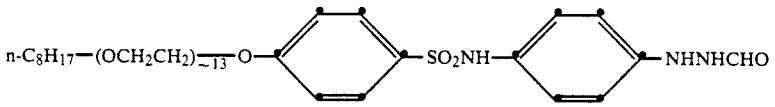
I-6
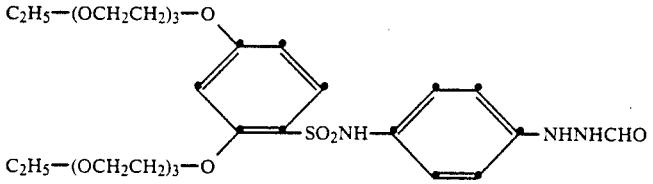
I-7
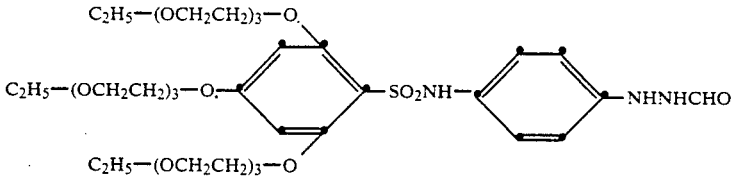
I-8
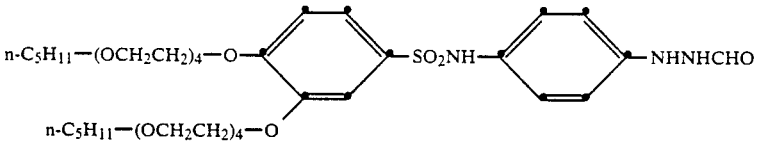
I-9
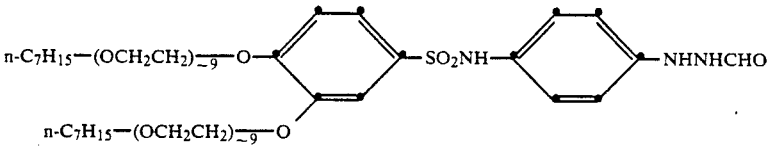
I-10
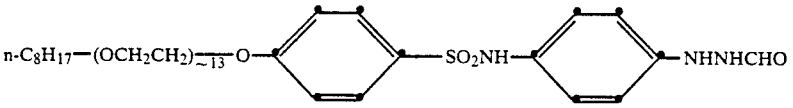
I-11
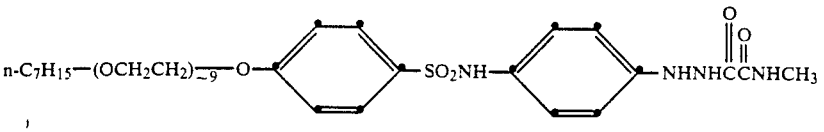

-continued

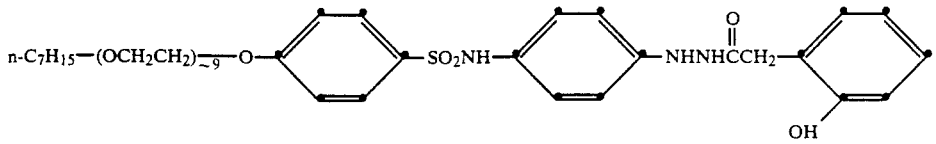

I-12

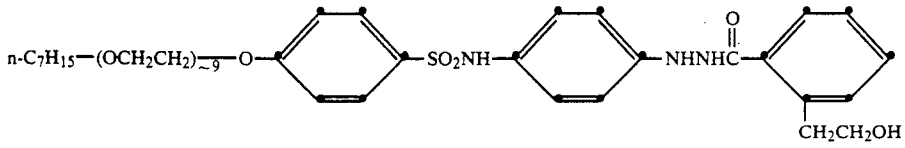

I-13

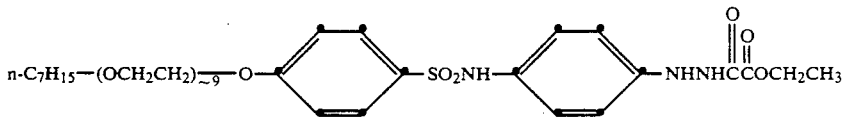

I-14

Synthesis of the aryl sulfonamidophenyl hydrazides of this invention is illustrated by the following synthesis for hydrazide I-8:

SYNTHESIS OF TETRAETHYLENEGLYCOL MONOPENTYL ETHER

Tetraethyleneglycol (1087 g, 5.60 mol) was heated at 100° C. for 30 min with stirring and vigorous N2 bubbling, then cooled to 60° C. A 50% NaOH solution (61.6 g, 0.77 mol) was added and the resulting solution was heated at 100°-105° C. for 30 min with N2 bubbling. The solution was cooled to 60° C., bromopentane (106 g, 0.70 mol) was added, and the reaction was heated at 100°-110° C. for 24 hr. The reaction solution was cooled, added to ice water and extracted twice with methylene chloride. The combined extracts were washed with 10% NaOH, water and brine; dried, and the solvent was removed in vacuo. The product (143 g, 78%) was a pale yellow oil.

SYNTHESIS OF PENTYLOXYTETRAETHYLENEOXY METHANESULFONATE

A solution of tetraethyleneglycol monopentyl ether (52.9 g, 0.20 mol), 4-dimethylaminopyridine (1.2 g, 0.01 mol), N,N-diisopropylethylamine (41.9 mL, 0.24 mol), and methylene chloride (400 mL) was cooled to 0° C. in an ice bath. Methanesulfonyl chloride (18.6 mL, 0.24 mol) was added over a 30-min period at 0° C. and the reaction was stirred at room temperature for 4 hr. The reaction mixture was added to ice water containing 10 mL of conc. HCl, the organic layer was separated, and the aqueous layer was extracted with methylene chloride. The combined extracts were washed with 10% NaOH, water and brine; dried, treated with charcoal, and filtered through a thin silica gel pad. The solvent was removed in vacuo; the residual product (62.6 g, 91%) was a yellow oil.

SYNTHESIS OF 1,2-DI-((TETRAETHYLENEOXY)PENTYLOXY)-BENZENE

A mixture of catechol (6.06 g, 0.055 mol), pentyloxytetraethyleneoxy methanesulfonate (34.3 g, 0.100 mol), anhydrous $K_2CO_3$ (20.7 g, 0.15 mol) and dry N,N-dimethylformamide (300 mL) was heated at 75°-85° C. for 20 hr. The reaction mixture was cooled, added to ice water and extracted with methylene chloride. The organic extracts were combined, washed with water and brine; dried, and the solvent was removed in vacuo. The product (24.3 g, 81%) was a pale yellow oil.

SYNTHESIS OF 3,4-DI-((TETRAETHYLENEOXY)PENTYLOXY)-BENZENESULFONYL CHLORIDE

To a solution of 1,2-di-((tetraethyleneoxy)pentyloxy)-benzene (21.7 g, 0.036 mol) in dry methylene chloride (200 mL) was added chlorosulfonic acid (2.8 mL, 0.432 mol) over a 20-min period and the reaction solution was stirred at room temperature for 24 hr. The solvent was removed in vacuo; the residue was a purple, viscous oil. The oil was redissolved in 20 mL of dry N,N-dimethylformamide (solution A).

To dry N,N-dimethylformamide (22 mL) was added phosphorus oxychloride (8.3 mL, 0.090 mol) over a 15-min period at 30°-35° C., the reaction solution was stirred at room temperature for 30 min, and cooled to 0° C. in an ice bath (solution B). The solution A was added over a 30 min period and the resulting solution was left standing at 0° C. for 18 hr. The ice bath was removed and the reaction was stirred at room temperature for 2 hr. The reaction solution was added to ice water and extracted with methylene chloride. The organic extracts were combined, washed with water and brine, dried, treated with charcoal, and filtered through a thin silica gel pad. The solvent was moved in vacuo; the residual product (17.9 g, 71%) was a yellow oil.

SYNTHESIS OF COMPOUND I-8

A mixture of 1-formyl-2-(4-nitrophenyl)hydrazide (4.63 g, 0.0255 mol), dry N,N-dimethylacetamide (40 mL) and 10% palladium on charcoal catalyst was hydrogenated at 50 psi over a 40-min period to the corresponding amine. The reaction mixture was dried, filtered and added to a solution of 3,4-di-((tetraethyleneoxy)pentyloxy)benzene sulfonyl chloride (17.9 g, 0.0255 mol) and dry N,N-dimethylacetamide (20 mL). The reaction solution was cooled to 0° C. in ice bath, N,N-diisopropylethylamine (4.5 mL, 0.0255 mol) was added, and the reaction was stirred at 0° C. for 30 min and at room temperature for 18 hr. The reaction was added to ice water and extracted with methylene chloride. The organic extracts were combined, washed with water and brine, dried, and the solvent was removed in vacuo. The residual oil was purified by chromatography on silica gel; the product (6.8 g, 36%) was a greenish semi-solid.

The invention is further illustrated by the following examples of its practice.

The term "partition coefficient", as used in these examples, refers to the log P value of the nucleator with respect to the system n-octanol/water as defined by the equation:

$$\log P = \log \frac{[X]_{octanol}}{[X]_{water}}$$

where X=concentration of the nucleator. The partition coefficient is a measure of the ability of the compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.52, Pomona College, Claremont, Calif. The higher the value of log P the more hydrophobic the compound.

Each coating used in the following examples was prepared on a polyester support, using a mono-dispersed 0.24 μm AgBrI (2.5 mol % iodide) iridium-doped emulsion at 3.51 g/m$^2$ Ag, 2.54 g gel/m$^2$, and 1.08 g latex/m$^2$ where the latex is a copolymer of methyl acrylate, 2-acrylamido-2-methylpropane sulfonic acid, and 2-acetoacetoxyethylmethylacrylate. The silver halide emulsion was spectrally sensitized with 214 mg/Ag mol of anhydro-5,5'-dichloro-9-ethyl-3,3'-di-(3-sulfopropyl)oxacarbocyanine hydroxide, triethylene salt and the emulsion layer was overcoated with gelatin containing polymethylmethacrylate beads. The nucleating agent was added as a methanol solution to the emulsion melts at a level in millimoles (mM) per mole of silver as hereinafter indicated. An "incorporated booster" was added as a methanol solution in an amount of 64.6 milligrams per square meter of photographic element. The compound employed as the "incorporated booster" is represented by the formula:

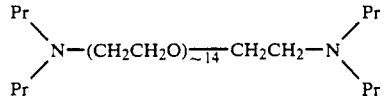

where Pr represents n-propyl. Coatings were exposed for five seconds to a 3000° K. tungsten light source and processed for 1 minute at 35° C. in the developer solution.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to two parts of water to produce a working strength developing solution with a pH of 10.5.

In the table which follows, the nucleators are of the following general formula, wherein Ar has the structure indicated in the table:

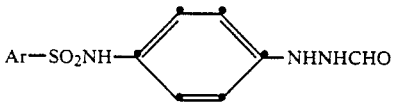

TABLE I

| Test No. | Ar | Mol. Wt. of Nucleator | Log P | Concentration of Nucleator mM/Ag mole | Relative Speed |
|---|---|---|---|---|---|
| 1. | 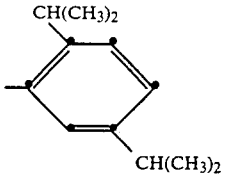  | 375.5 | 3.44 | 1.0 | 87 |
| 2. | 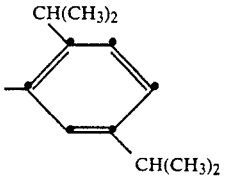  | 375.5 | 3.44 | 2.0 | 100 |
| 3. | 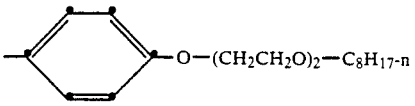  | 507.7 | 3.93 | 1.0 | 87 |

TABLE I-continued

| Test No. | Ar | Mol. Wt. of Nucleator | Log P | Concentration of Nucleator mM/Ag mole | Relative Speed |
|---|---|---|---|---|---|
| 4. | 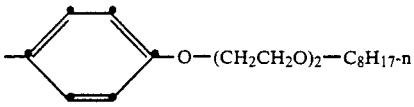 | 507.7 | 3.93 | 2.0 | 93 |
| 5. | 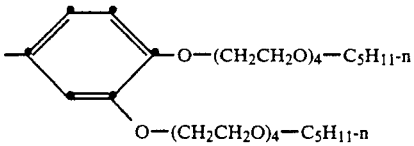 | 816 | 4.02 | 1.0 | 98 |
| 6. | 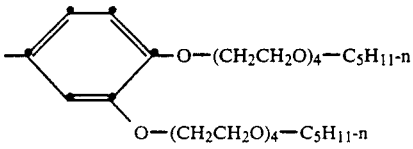 | 816 | 4.02 | 1.9 | 105 |
| 7. | 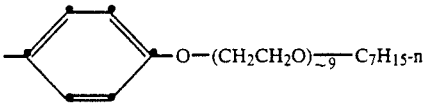 | 802 | 3.9 | 1.0 | 105 |
| 8. | 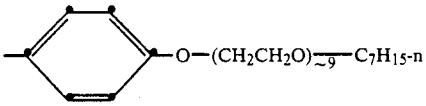 | 802 | 3.9 | 2.0 | 110 |

As indicated by the data in Table I, the four nucleators tested were closely matched in their oil/water partitioning properties as indicated by the log P values. The nucleator employed in Tests 1 and 2, which is outside the scope of the present invention, is Compound No. 13 of U.S. patent application Ser. No. 167,814, filed Mar. 14, 1988 to which reference has been made hereinbefore. The nucleator employed in Tests 3 and 4, which is also outside the scope of the present invention, has a group comprised of only two repeating ethyleneoxy units as a substituent of the "ballast". The nucleator employed in Tests 5 and 6 (hydrazide I-8) and the nucleator employed in Tests 7 and 8 (hydrazide I-4) are both within the scope of the present invention. The former includes two groups each of which is comprised of four repeating ethyleneoxy units and the latter includes a group comprised of approximately nine repeating ethyleneoxy units.

All four nucleators were effective in providing lith-like contrast and upper scale density enhancement. The nucleator employed in Tests 5 and 6 and the nucleator employed in Tests 7 and 8 unexpectedly exhibited beneficial effects upon lower scale activity (speed) and this beneficial effect was greater with an increased number of ethyleneoxy units in the substituent group. Comparing Test 7 with Test 2, it is seen that somewhat greater speed was achieved in Test 7 even though the molar concentration of nucleator was half that used in Test 2. This highly desirable result is achieved because the intrinsic activity of the nucleator is increased by the presence in the "ballast" of at least one group comprised of at least three repeating ethyleneoxy units.

The invention has been described in detail with particular reference to certain preferred embodiments thereof, but it will be understood that variations and modifications can be effected within the spirit and scope of the invention.

What is claimed is:

1. A silver halide photographic element adapted to form a high contrast image upon development with an aqueous alkaline developing solution, said element including at least one layer comprising, as a nucleating agent, an aryl sulfonamidophenyl hydrazide of the formula:

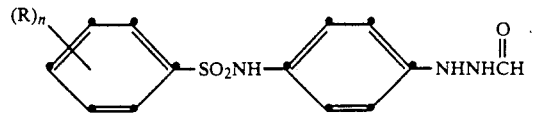

where each R is a monovalent group comprised of at least three repeating ethyleneoxy units and n is 1 to 3.

2. A photographic element as claimed in claim 1 wherein each R is a monovalent group comprised of at least six and up to fifty repeating ethyleneoxy units.

3. A photographic element as claimed in claim 1 wherein said hydrazide has a partition coefficient of at least three.

4. A photographic element as claimed in claim 1 wherein said hydrazide is present in said element in an amount of from about $5\times10^{-4}$ to about $5\times10^{-2}$ moles per mole of silver.

5. A photographic element as claimed in claim 1 wherein said hydrazide has the formula:

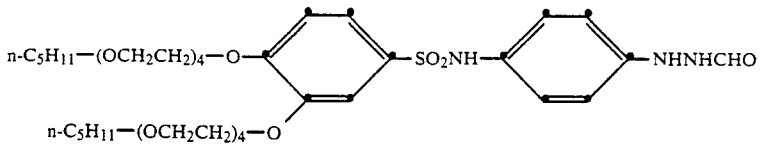
6. A photographic element as claimed in claim 1 wherein said hydrazide has the formula:
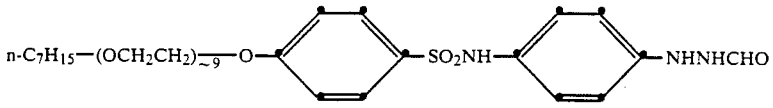
* * * * *